United States Patent [19]

Herring, III

[11] Patent Number: 4,760,793

[45] Date of Patent: Aug. 2, 1988

[54] MULTI-RANGE SHOT SHELL

[75] Inventor: Edward I. Herring, III, Cabot, Ark.

[73] Assignee: E. I. Du Pont de Nemours and Company, Wilmington, Del.

[21] Appl. No.: 113,436

[22] Filed: Oct. 28, 1987

Related U.S. Application Data

[63] Continuation of Ser. No. 894,203, Jan. 9, 1987, abandoned.

[51] Int. Cl.[4] ..... F42B 7/02

[52] U.S. Cl. ..... 102/460; 102/451

[58] Field of Search ..... 102/448, 451, 460, 454

[56] References Cited

U.S. PATENT DOCUMENTS

| | | | |
|---|---|---|---|
| 41,590 | 2/1864 | Allen | 102/460 |
| 1,277,810 | 3/1918 | Woodhouse | 102/460 |
| 1,575,716 | 3/1926 | Pavek | 102/460 |
| 1,583,559 | 5/1926 | Kenneweg . | |
| 2,440,568 | 4/1948 | Arter | 102/42 |
| 3,074,344 | 1/1963 | Devaux | 102/42 |
| 3,402,664 | 9/1968 | Cramer | 102/451 |
| 3,598,057 | 8/1971 | Potter | 102/91 |
| 3,796,157 | 3/1974 | Anderson | 102/460 |
| 3,952,659 | 4/1976 | Sistino | 102/42 |
| 3,996,865 | 12/1976 | Dwyer | 47/1 |

FOREIGN PATENT DOCUMENTS

| | | | |
|---|---|---|---|
| 562499 | 11/1923 | France | 102/460 |

*Primary Examiner*—Harold J. Tudor

[57] ABSTRACT

Shot shell having a stratified payload of at least two different shot sizes, the larger diameter shot being closer to the mouth of the shell than the smaller diameter shot.

7 Claims, 1 Drawing Sheet

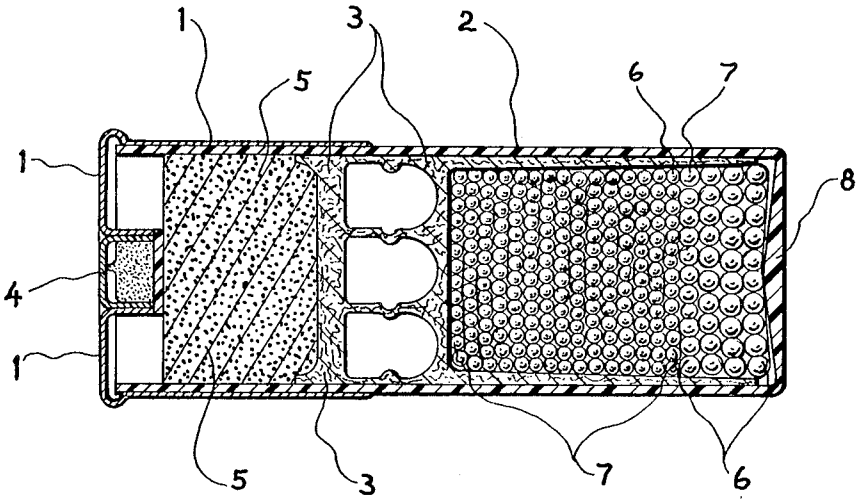
1
2
3
4
5
6
7
8

MULTI-RANGE SHOT SHELL

This application is a continuation of application Ser. No. 894,203 filed Jan. 9, 1987, now abandoned.

BACKGROUND OF THE INVENTION

Shot shells comprise an anterior mouth end and a posterior head end with a powder charge positioned at the head end. A wad is typically positioned over the powder charge toward the mouth end of the cartridge with the payload being contained in the wad. Shot shells are designed to have maximum effectiveness within a designated range. This range is a function of the velocity as well as the size of the shot payload. While effective for many types of hunting, this is a handicap with certain types of small game that might appear at short or long ranges, in which situation the hunter would be unable to change the size of the shot to compensate for the distance at which the game is found.

Many attempts have been made to overcome the limitations of range within a single shot shell. For example, Woodhouse, in U.S. Pat. No. 1,277,810, suggested incorporating two sizes of shot in a single cartridge, in which smaller shot was positioned circumferentially around a core of larger shot. Unfortunately, this arrangement destroys the effectiveness of the charge of small shot, in that the central larger diameter shot would, shortly after exiting the muzzle of the shotgun, disturb the pattern of the circumferential small shot. Similarly, a substantially homogeneous mixture of small and large shot would result in the degradation of the pattern performance of the shot, especially at long ranges.

SUMMARY OF THE INVENTION

The instant invention provides an improved shot shell cartridge which is capable of generating outstanding pattern performance at both long and short ranges, with excellent penetration capability and energy at both ranges.

Specifically, the instant invention provides a shot shell having a head end and a mouth end, a wad and a stratified payload of shot positioned in the wad, the payload comprising a charge of larger diameter shot and one or two charges of smaller diameter shot, the charge of larger diameter shot being closer to the mouth end of the shell than each charge of smaller diameter shot, the charge of larger diameter shot comprising about from 20 to 35% by weight of the entire shot payload, each pellet in the charge of larger diameter shot being at least about 25% greater in weight than each pellet in the charge of smaller diameter shot.

BRIEF DESCRIPTION OF THE DRAWING

The drawing is a cross-sectional representation of a shot shell of the present invention.

DETAILED DESCRIPTION OF THE INVENTION

The present invention relates to an improvement over conventional shot shells comprising a head and a mouth end, with a charge of propellant powder at the head end, and a wad containing a shot payload at the mouth end of the shell. The invention relates to the improvement of providing a stratified payload of shot, consisting of a charge of larger diameter shot and one or two charges of smaller diameter shot, the charge of larger diameter shot being positioned at the mouth end of the shell.

The shot charges can be prepared from materials conventionally used in shot shells, including, for example, lead and steel. The shot used in the present stratified payload comprises at least two distinct shot sizes, the larger size shot being at least about 25% greater in weight than the smaller diameter shot, and preferably at least about 100% greater. While more than two sizes of shot can be used in accordance with the present invention, it is particularly preferred to use only two sizes of shot. In an arrangement of the shot sizes in the context of the present invention, the larger diameter shot are closer to the mouth end of the shot shell than the smaller diameter shot. Each shot charge is substantially homogeneous, that is, there is little or no mixing of the two or more sizes of shot within the entire shot payload. However, it has been found unnecessary, and, in fact, undesirable, to have a separatory barrier or membrane between the two sizes of shot.

The larger diameter shot, in the present stratified payload, comprises about from 20 to 35% by weight of the entire shot payload. Greater than about 35% of the larger diameter shot within the shot payload will result in loss of pattern density, while less than about 20% will not provide the required energy and penetration capability of the larger diameter shot needed for longer range performance. Using lead shot, the larger diameter shot preferably comprises about from 24 to 30% of the payload. With steel shot, the larger diameter shot preferably comprises about from 30 to 35% of the payload.

The larger diameter shot, in accordance with the present invention, is at least about 25% greater in weight than the smaller diameter shot on a per-pellet basis. Representative combinations of large and small diameter shot can be designated using the standard shot sizes set up by the Small Arms and Ammunition Manufacturers Institute (SAAMI). Using those shot sizes, combinations which have been found particularly effective in the present shot shell cartridges, using lead shot, are sizes 2 and 6, 2 and 4, or BB and 4, while representative steel shot size combinations include BB and 2, BB and 4, BBB and 2, or 2 and 6. If three shot sizes are used, the third size is beneficially between the highest and lowest suggested above, for example, 2, 4 and 6.

The present stratified payloads are applicable to a wide variety of shot shell cartridges. However, the present stratified payloads have been found to be especially effective for 10, 12, 16 and 20 gauge shotgun shells and particularly 12 gauge shotgun shells in both regular and magnum loads.

A representative shotshell of the present invention is more fully illustrated in the FIGURE, and comprises steel cap 1, plastic body 2, plastic base wad 3, and primer 4. The shell is charged with propellant powder 5. The payload is made up of layers of large diameter shot 6 and small diameter shot 7. The shell mouth is crimped at position 8 to retain the shot within the shell.

Upon firing the present shotshell, the large diameter and small diameter shot components exit the muzzle of the gun at the same velocity. However, the greater mass of the large diameter shot permits those shot pellets to retain their velocity longer than the small diameter shot, and is accordingly effective at a greater range. Even at a shorter range in which the small diameter shot are effective, the large diameter shot can have added benefit. The larger shot are less susceptible to deflection by underbrush, and would penetrate certain types of underbrush that the smaller diameter shot would not be able to penetrate, even though within the effective range of the smaller shot. The larger diameter shot will also have greater penetration effect, especially at shorter ranges, and would be particularly advantageous for striking game at unusual angles where the smaller diameter shot would deflect off of bone or muscle structure. At the same time, the presence of the smaller shot at short range provides a significantly denser pattern than the larger shot would provide.

The larger shot in the present stratified payload, due to their lower rate of deceleration, provide greater pellet energy downrange and supplement the smaller shot to maintain good pattern density. Consequently, shotshells using the stratified payload are more effective than conventional shotshells which cannot deliver both good pattern density and high downrange pellet energy simultaneously.

The sequence in which the two or three shot sizes exit the muzzle of the gun is also important, because of the difference in the rates of deceleration of the large and small shot. The larger shot pellets, with their lower rate of deceleration, form a shot cloud which drifts away from the cloud of shall shot and eliminate the possibility of interference between the two shot clouds. The elimination of pellet interference is important to the maintenance of good pattern performance.

The invention is further illustrated by the following specific examples.

EXAMPLE 1 and COMPARATIVE EXAMPLE A

A 12 gauge shotgun shell was prepared using a conventional powder charge and shot wad and having a total payload of $1\frac{7}{8}$ ounces of lead shot. The shot payload consisted of $1\frac{3}{8}$ ounces of smaller diameter No. 6 shot loaded closer to the head and $\frac{1}{2}$ ounce of larger diameter No. 2 shot loaded closer to the mouth end of the shell. This cartridge was compared, in Comparative Example A, to a 12 gauge cartridge having a similar total payload of $1\frac{7}{8}$ ounces, but composed exclusively of the smaller diameter No. 6 shot.

The two shells were tested and compared for total energy at various distances ranging from 1 to 60 yards, and the results are summarized in Table I. The payload energy of the shell was determined at various ranges according to techniques established by SAAMI according to the formula:

$$\text{Pellet Energy} = MV^2/450436$$

in which M is the mass in grains and V is the velocity in feet per second. The Pellet Energy is in foot-pounds.

The stratified payload of the present invention provided a substantial increase in energy at the target, with minimal sacrifice of pattern density.

EXAMPLE 2 and COMPARATIVE EXAMPLE B

The general procedure of Example 1 and Comparative Example A was repeated, using steel shot instead of the lead shot payload in Example 1. $1\frac{1}{4}$ ounces of shot was used for the payload in both Example 2 and Comparative Example B.

In Example 2, the shotshell was first loaded with $\frac{7}{8}$ ounce of smaller diameter No. 2 shot followed by $\frac{3}{8}$ ounce of larger diameter BB shot closer to the mouth end of the cartridge.

In Comparative Example B, the entire payload consisted of $1\frac{1}{4}$ ounces of the smaller diameter No. 2 shot.

The two shotshells were compared at ranges of 1 to 60 yards, as before, and the energy generated at the various distances was calculated on the basis of standard velocity measurements. The shotshells using the stratified payload of the present invention were found to exhibit a marked increase in downrange energy, as summarized in Table II.

The shotshells of the present invention exhibited excellent pattern performance at all ranges, and provided greater payload energy at the longer ranges.

TABLE I

| | | | | Lead Shot | | | | | | |
|---|---|---|---|---|---|---|---|---|---|---|
| | | | | Distance | | | | | | |
| Example | Payload | Pellets | Units of Measurement | 3 FT | 10 YDS | 20 YDS | 30 YDS | 40 YDS | 50 YDS | 60 YDS |
| 1 | $1\frac{3}{8}$ oz. #6 shot | 311 | Velocity (fps) #6 shot | 1210 | 1064 | 911 | 786 | 684 | 598 | 526 |
| | | | Ind. Pellet Energy (ft/lbs) #6 shot | 6.4 | 4.9 | 3.6 | 2.7 | 2.0 | 1.6 | 1.2 |
| | | | Total Energy (ft/lbs) #6 shot | 1990 | 1524 | 1120 | 840 | 622 | 498 | 373 |
| | $\frac{1}{2}$ oz. #2 shot | 44 | Velocity (fps) #2 shot | 1210 | 1098 | 974 | 867 | 775 | 697 | 630 |
| | | | Ind. Pellet Energy (ft/lbs) #2 shot | 16.3 | 13.4 | 10.5 | 8.4 | 6.7 | 5.4 | 4.4 |
| | | | Total Energy (ft/lbs) #2 shot | 717 | 590 | 462 | 370 | 295 | 238 | 194 |
| | | | Total Duplex Payload Energy (ft/lbs) | 2707 | 2114 | 1582 | 1210 | 917 | 736 | 567 |
| A | $1\frac{7}{8}$ oz. #6 shot | 424 | Velocity (fps) #6 shot | 1210 | 1064 | 911 | 786 | 684 | 598 | 526 |
| | | | Ind. Pellet Energy (ft/lbs) #6 shot | 6.4 | 4.9 | 3.6 | 2.7 | 2.0 | 1.6 | 1.2 |
| | | | Total Payload Energy (ft/lbs) #6 shot | 2714 | 2078 | 1526 | 145 | 848 | 678 | 598 |
| | | | % Energy Improvement of Duplex Payload | 0 | 1.7 | 3.7 | 5.7 | 8.1 | 8.6 | 11.4 |

TABLE II

| Example | Payload | Pellets | Units of Measurement | Steel Shot Distance 3 FT | 10 YDS | 20 YDS | 30 YDS | 40 YDS | 50 YDS | 60 YDS |
|---|---|---|---|---|---|---|---|---|---|---|
| 2 | $\frac{7}{8}$ oz. #2 shot | 109 | Velocity (fps) #2 shot | 1375 | 1204 | 1021 | 873 | 755 | 658 | 577 |
| | | | Ind. Pellet Energy (ft/lbs) #2 shot | 14.75 | 11.80 | 8.13 | 5.95 | 4.54 | 3.39 | 2.60 |
| | | | Total Energy (ft/lbs) #2 shot | 1608 | 1286 | 886 | 649 | 495 | 370 | 283 |
| | $\frac{3}{8}$ oz. BB shot | 27 | Velocity (fps) BB | 1375 | 1229 | 1066 | 929 | 817 | 724 | 646 |
| | | | Ind. Pellet Energy (ft/lbs) BB | 25.48 | 21.17 | 15.48 | 11.92 | 9.03 | 7.13 | 5.62 |
| | | | Total Energy (ft/lbs) BB | 688 | 572 | 418 | 322 | 244 | 193 | 152 |
| | | | Total Duplex Payload Energy (ft/lbs) | 2296 | 1858 | 1304 | 971 | 739 | 563 | 435 |
| B | $1\frac{1}{4}$ oz. #2 shot | 156 | Velocity (fps) #2 shot | 1375 | 1204 | 1021 | 873 | 755 | 658 | 577 |
| | | | Ind. Pellet Energy (ft/lbs) #2 shot | 14.75 | 11.80 | 8.13 | 5.96 | 4.54 | 3.39 | 2.60 |
| | | | Total Payload Energy (ft/lbs) #2 shot | 2301 | 1841 | 1268 | 928 | 693 | 527 | 406 |
| | | | % Energy Improvement of Duplex Payload | 0 | 0.9 | 2.8 | 4.6 | 6.6 | 6.8 | 7.1 |

I claim:

1. A shot shell having a head end and a mouth end, a wad and a stratified payload of shot positioned in the wad, the payload comprising a charge of larger diameter shot and one or two charges of smaller diameter shot, the larger diameter shot charge being closer to the mouth end of the shell than each charge of smaller diameter shot, the charge of larger diameter shot comprising about from 20 to 35% by weight of the entire shot payload, each pellet of the charge of larger diameter shot being at least about 25% greater in weight than each pellet in the charge of smaller diameter shot, the charges of larger diameter shot and smaller diameter shot being free from separatory barriers or membranes between the charges.

2. A shot shell of claim 1 having two sizes of shot.

3. A shot shell of claim 1 wherein the payload consists essentially of lead shot.

4. A shot shell of claim 3 wherein the charge of larger diameter shot comprises about from 24 to 30% by weight of the entire shot payload.

5. A shot shell of claim 1 wherein the shot payload consists essentially of steel shot.

6. A shot shell of claim 5 wherein the charge of larger diameter shot comprises about from 30 to 35% by weight of the entire shot payload.

7. A shotshell of claim 5 wherein each shot of the larger diameter shot is at least about 100% greater in weight than each shot of the smaller diameter shot.

* * * * *